US009388575B1

(12) United States Patent
Gomez et al.

(10) Patent No.: US 9,388,575 B1
(45) Date of Patent: Jul. 12, 2016

(54) SUSPENDED HANGER AND ANCHOR PIECE

(71) Applicant: Blue Point Fastening, Inc., Chino Hills, CA (US)

(72) Inventors: Paul Gomez, Rowland Heights, CA (US); Bing Liu, Chino Hills, CA (US)

(73) Assignee: BLUE POINT FASTENING INC., Chino Hills, CA (US)

( * ) Notice: Subject to any disclaimer, the term of this patent is extended or adjusted under 35 U.S.C. 154(b) by 0 days.

(21) Appl. No.: 14/859,926

(22) Filed: Sep. 21, 2015

(51) Int. Cl.
*A47H 1/10* (2006.01)
*E04B 9/18* (2006.01)
*F16M 13/02* (2006.01)

(52) U.S. Cl.
CPC ..... *E04B 9/18* (2013.01); *F16M 13/027* (2013.01)

(58) Field of Classification Search
USPC ..... 248/317, 342, 343; 52/506.06, 506.07, 52/506.08
See application file for complete search history.

(56) References Cited

U.S. PATENT DOCUMENTS 5,351,920 A * 10/1994 Decky ..... F16L 3/13 248/222.52
5,664,754 A * 9/1997 Gaenslen ..... E04B 9/006 248/300
6,789,364 B2 * 9/2004 Popovich ..... E04B 9/18 248/317
7,967,272 B2 * 6/2011 Nilsen ..... E04B 9/006 248/214
8,672,281 B2 * 3/2014 Ernst ..... E04B 9/18 248/327
2003/0168563 A1 * 9/2003 Masas ..... E04B 9/18 248/317
2003/0201373 A1 * 10/2003 Masas ..... E04B 9/006 248/317

* cited by examiner

*Primary Examiner* — Steven Marsh

(57) ABSTRACT

The present invention is an L-bracket formed, shaped and threaded to become a suspended ceiling anchor capable of engaging multiple diameters of threaded hanging rods, providing spacing means between threaded sections for a user to avoid threading the end of a threaded hanging rod up to two thirds of the end threads of the threaded hanging rod, thereby reducing installation time and complexity.

10 Claims, 5 Drawing Sheets

SUSPENDED HANGER AND ANCHOR PIECE

FIELD OF THE INVENTION

The present invention is broadly directed to installation of internal hanging ceilings and more particularly to an improved anchor device affixed at a desired position to a solid portion of said ceiling for connecting a threaded hanger from which said internal hanging ceiling will be suspended.

BACKGROUND OF THE INVENTION

In construction of commercial offices, immediately visible ceilings are often comprised of lightweight fiber panels supported from a horizontal framework of aluminum struts and T- or L-cross section pieces, which also generally will include recessed lighting fixtures. The visible portion of the internal ceiling is actually supported from a horizontal structure above it, which horizontal structure has sufficient structural strength to prevent the suspended ceiling from falling into the room space below. Said horizontal structure may be formed of metal beams or plates, wood beams or sheets, concrete, or similar structural materials.

It is well known that installation of suspended ceilings is generally accomplished by way of first setting anchors into the horizontal structure by workers standing at floor level, which is often a distance of five or more feet from a worker's elevated arms. Because of the number of anchors required for installation of suspended ceilings from the horizontal structure, it is not efficient for workers to use a ladder to set said anchors. Instead, it is common practice for workers to use a special tool with an explosive charge device and anchoring shaft at the end of a pole to work from ground level to fix said anchors to the horizontal structure, as shown and described in U.S. Pat. No. 5,544,800, which incorporated by reference herein.

U.S. Pat. No. 4,979,715 discloses the simplest anchor and twisted hanger assembly, one which uses a screw as an anchor that must be directly screwed into a horizontal structure. U.S. Pat. No. 8,602,365 discloses a method of attaching a threaded positioner on a hanging threaded rod. U.S. Pat. No. 5,667,181 discloses an anchor with a nut with a single diameter, but which can be replaced with a nut of a different diameter. U.S. Pat. No. 3,266,202 discloses an anchor using a triangular flange but introducing an efficient means for forming a threaded section in the anchor, i.e., stamping lateral semi-circular sections in adjacent and opposite directions, within which concave portions are formed threads. U.S. Pat. No. 2,725,127 discloses an anchor that is capable of supporting a threaded hanging rod of a single diameter.

Some of the problems hanger assemblies of anchors and their threaded hanging rod have been their cost, multiple parts, and difficulty of installation. Such hanger assemblies have a minimum of three parts and may have five or more, depending on whether a separate fixing device or washer is employed. Since the installation is usually done on a scaffold or step ladder, loose parts can be a problem. Even if all of the parts as a set are packaged, the opening of the package and assembly of the parts can be a problem. If one of the parts drops or rolls away, the installer has to climb down to retrieve the part, if it can be found, or get another package. Multiple part fasteners always take more time to install, and are more costly, especially if packaged.

Structural and weight requirements of a specific area of a suspended ceiling are often not known beforehand. It is well known that later modifications to a planned installation of a suspended ceiling may require a change in diameter of threaded hanging rods than those installed in said anchors, requiring either installation of adjacent anchors capable of receiving greater diameter threaded hanging rods or manually changing nuts by tedious ladder supported work as in the '181 patent.

There is a need for an anchor for suspended ceilings which is inexpensive, lightweight, and can accommodate more than one diameter of threaded hanging rods.

SUMMARY OF THE INVENTION

The present invention is an L-bracket formed, shaped and threaded to become a suspended ceiling anchor capable of engaging multiple diameters of threaded hanging rods, providing spacing means between threaded sections for a user to avoid threading the end of a threaded hanging rod up to two thirds of the end threads of the threaded hanging rod, thereby reducing installation time and complexity.

The present invention has improved on the stamped, threaded, and semi-circular sections of the '202 patent. The present inventor has found that all structural requirements for suspended ceilings, even for engineering in earthquake prone areas, are met with providing only three semi-circular sections (instead of four as taught in the '202 patent), reducing installation time and requirements. Further, by providing non-threaded spaces between the semi-circular sections, the present invention allows a user to avoid up to two thirds or more of the threading work that prior art anchors as shown in the '202 patent.

The present invention provides two or more vertically adjacent rod areas, each comprising three semi-circular sections, where each vertically inferior rod area comprises an effective threaded diameter substantially greater than a rod area above it. Thus, a user installing a smaller diameter threaded hanging rod will insert it into and bypass the threads of the lowest rod area of the invention device until the smaller diameter threaded hanging rod engages an effective threaded diameter of a higher rod area that results in threaded engagement of the smaller diameter threaded hanging rod with the semicircular sections of the higher rod area.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
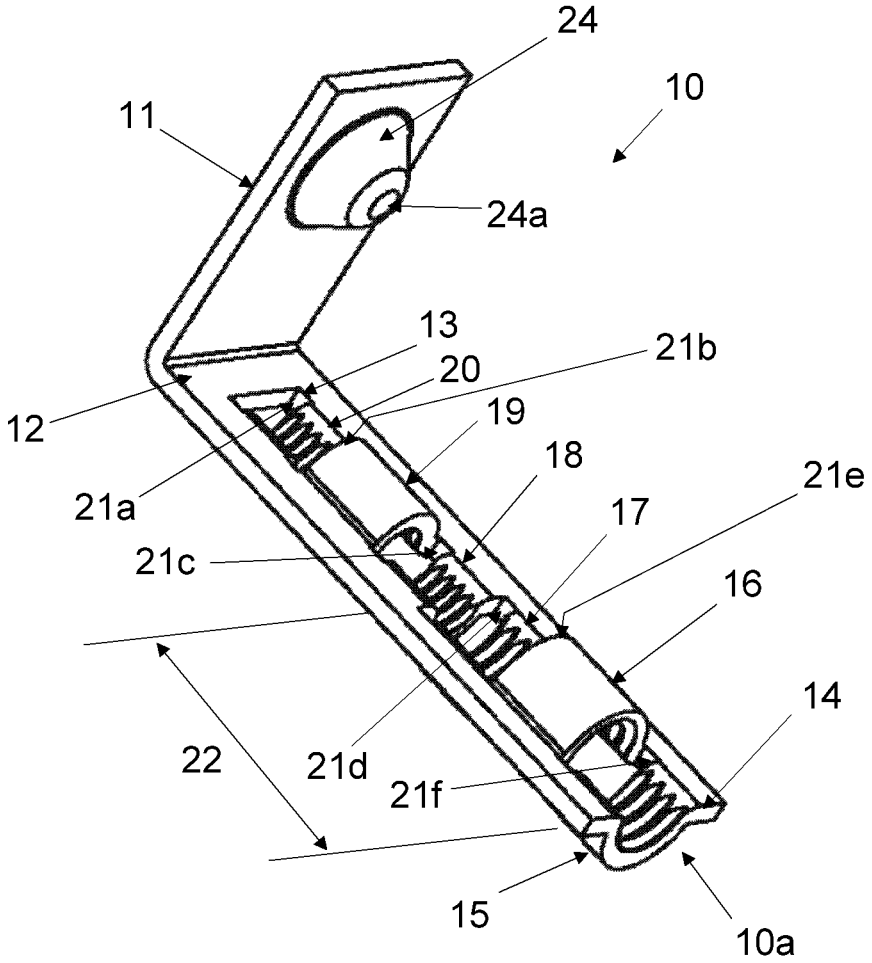
FIG. 1 is a side perspective view of the invention anchor, showing means for receiving threaded hanging rods of multiple diameters.

Referring to the drawings in more detail, FIG. 1 is a side perspective view of the invention anchor 10 is generally an L-shaped bracket, showing means for receiving threaded hanging rods of multiple diameters along direction 10*a*. Plate 11 comprises a punched down conical receiver 24 defining opening 24*a*, which is adapted to receive a nail, screw, bolt or the like from below and which then is driven into the horizontal structure to affix anchor 10 into the horizontal structure.

By way of such affixation of plate 11 to the horizontal structure, plate 12 is suspended vertically downward, causing direction 10*a* to also be aligned vertically as well. A central portion of plate 12 from elevation 13 to end 14 comprises two rod areas in which two or more vertically adjacent rod areas (larger diameter and lower rod area 22 is shown), each comprising three semi-circular sections (sections 15, 16 and 17 in lower rod area 22) (sections 18, 19 and 20 in an upper rod area), where each vertically inferior rod area 22 comprises an effective threaded diameter substantially greater than the upper rod area above it. Thus, a user installing a smaller diameter threaded hanging rod will insert it into and bypass the threads of the lowest rod area 22 of the invention device until the smaller diameter threaded hanging rod engages an effective threaded diameter of an upper rod area that results in threaded engagement of the smaller diameter threaded hanging rod with the semicircular sections of the higher rod area.

It is critical to the operation of the invention anchor 10 that non-threaded sections 21*b* through 21*f* be provided between the separated threaded sections 15 through 20 respectively. A non-threaded section 21*a* is optional for the invention. Non-threaded sections 21*b* through 21*f* allow easy insertion of a threaded hanging rod as described below. Further, it is critical to the formation of sections 15 through 20 that non-threaded sections 21*a* through 21*f* be formed before forming of sections 15 through 20. The threaded sections shown in the '202 patent cannot be formed by stamping—the stamping process would mis-form the semi-circular sections, making them unusable for later machining of threads and threaded connection to a threaded hanging rod. Those threaded sections of the '202 patent must be formed in some other machining method other than stamping.

Formation of the sections 15 through 20 in the central portion of plate 12 is important to the invention concept, in that no separate pieces are required for this invention anchor than the piece shown in FIG. 1 (excepting some means for fixing anchor 10 to a horizontal structure). In a first step, plate 12 is flat and has no openings or indentations. In a second step, slots are cut which ultimately become non-threaded sections 21*a* through 21*f* defined in plate 12. In a third step, a convex stamp first stamps the concave semi-circular shapes of sections 15, 17, 18 and 20. In a fourth step, plate 12 is flipped over and a convex stamp first stamps the concave semi-circular shapes of sections 16 and 19. In a fifth step, threads are cut in sections 18, 19, and 20. In a sixth step, threads are cut in sections 15, 16 an 17.

One skilled in the art will appreciate from the disclosure of the figures and this description that each section of lower rod area 22 or the upper rod area are adapted to engage only one side of a threaded hanging rod, but that forming vertically adjacent threaded sections of the rod areas on opposite sides of the flat portion of plate 12 results in a structure which provides substantially the same resistance to vertical downward for on an engaged threaded hanging rod as a fully cylindrical threaded bore or at least dramatically more such support than the short threaded sections shown in the '127 or '181 patents could possible provide.

Figure 2:
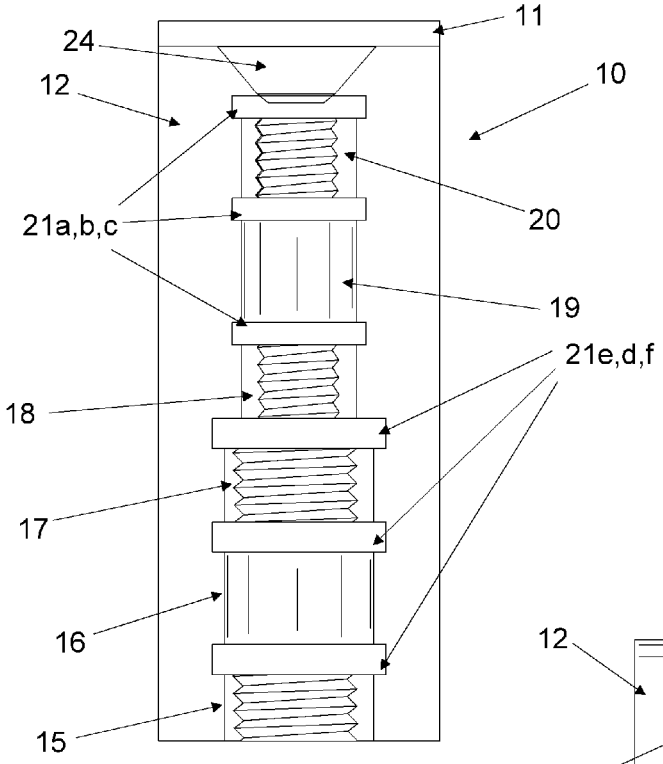
FIG. 2 is front view of FIG. 1.
Figure 3:
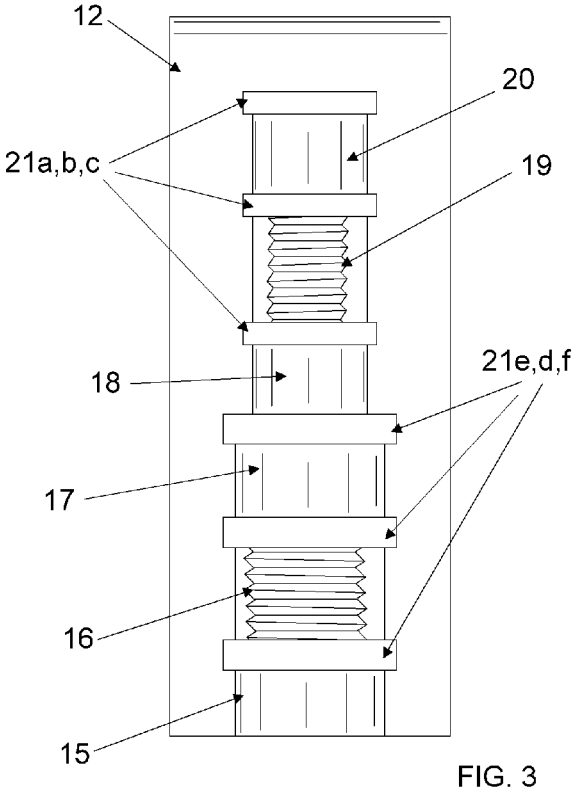
FIG. 3 is a rear view of FIG. 1.
Figure 4:
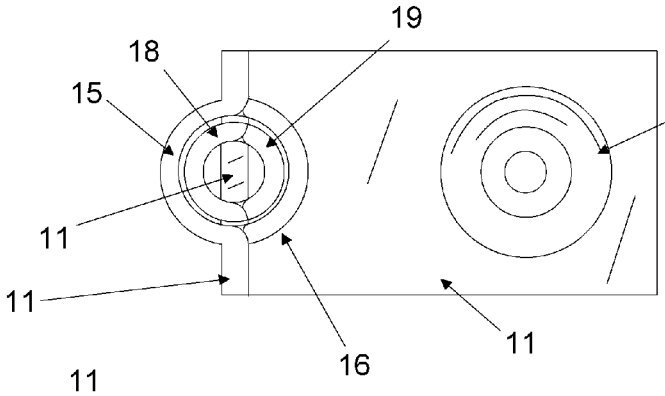
FIG. 4 is a bottom view of FIG. 1.
Figure 5:
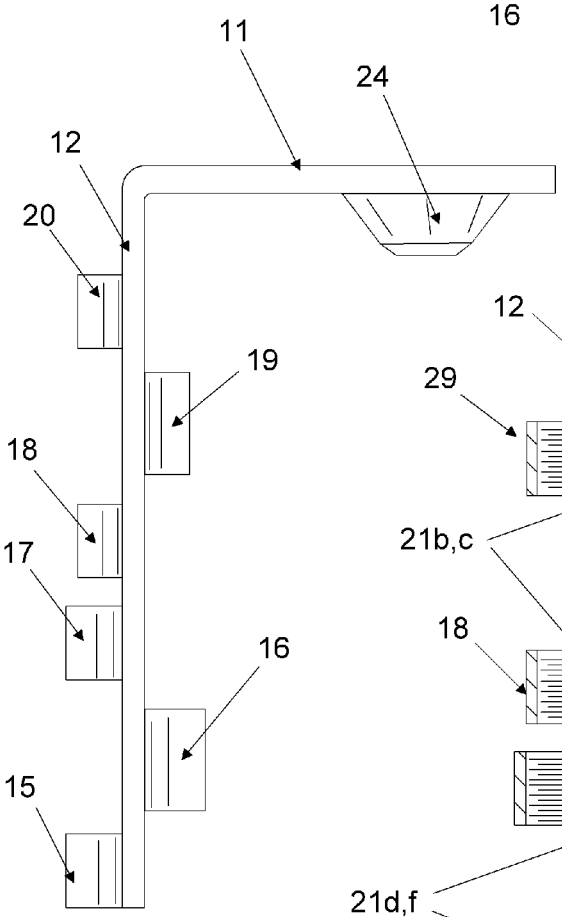
FIG. 5 is a side view of FIG. 1.
Figure 6:
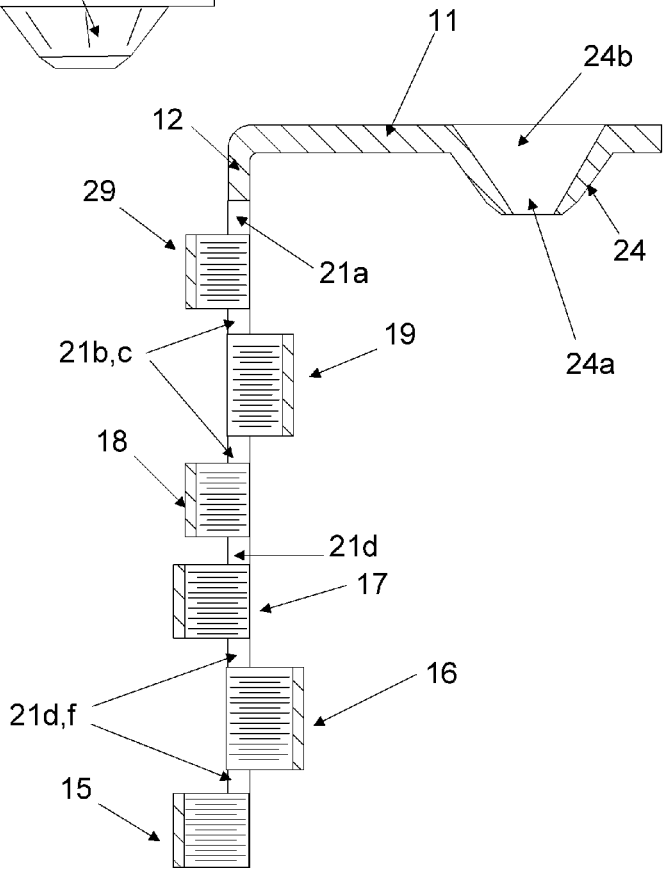
FIG. 6 is cutaway view of FIG. 5.

FIG. 2 is front view of the anchor 10 FIG. 1. FIG. 3 is a rear view of the anchor 10 FIG. 1. FIG. 4 is a bottom view of the anchor 10 FIG. 1, showing a much smaller threaded diameter of section 18 than that of section 15. FIG. 5 is a side view of the anchor 10 FIG. 1. FIG. 6 is cutaway view of the anchor 10 FIG. 5, showing a punched down space 24*b* and opening 24*a*, whereby space 24*b* results from a stamping operation of a flat plate 11 to accommodate fixing means driven with sufficient force to deform receiver 24 upward.

Figure 7:
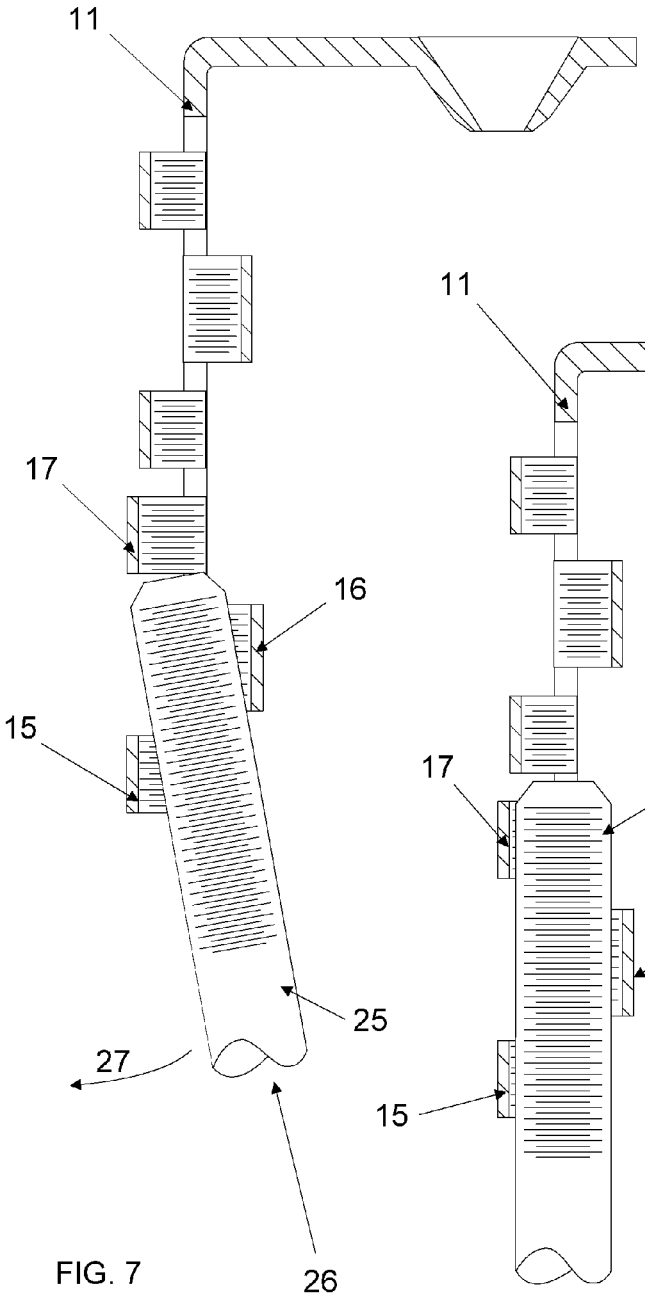
FIG. 7 is the anchor of FIG. 6 showing an angled insertion of a largest diameter threaded hanging rod into the invention hanger without need for threading for up to two thirds of the engaging threads.

FIG. 7 is the anchor of FIG. 6 showing an angled insertion along paths 26 and 27 of a largest diameter threaded hanging rod 25 past the threads of sections 15 and 16 into the invention hanger 10 without need for threading for up to two thirds or more of the engaging threads in sections 15 and 16.

Figure 8:
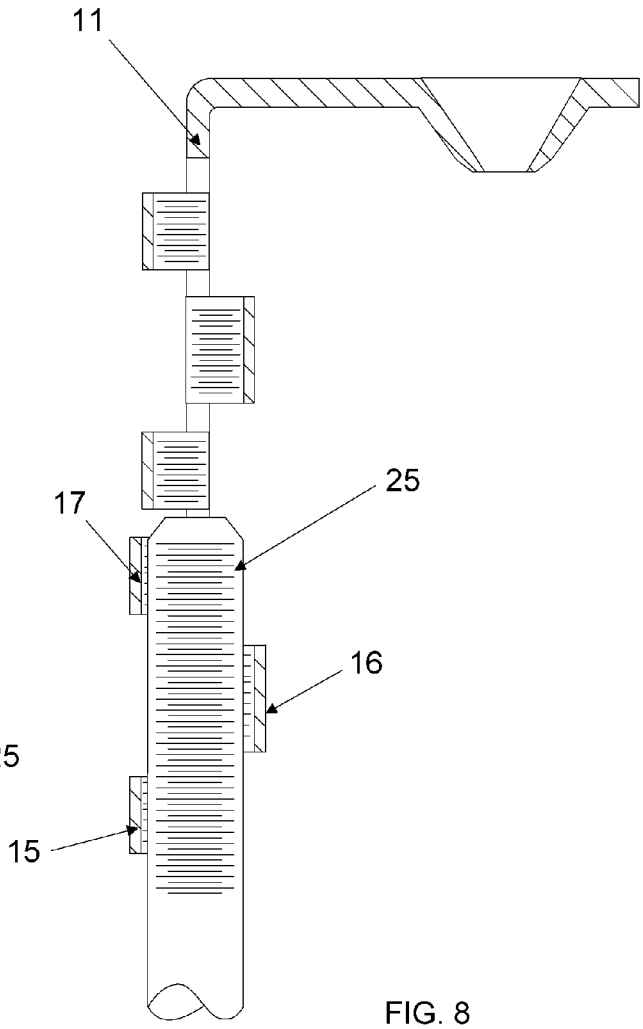
FIG. 8 is the assembly of FIG. 7 showing the largest diameter threaded hanging rod in a fully threaded engagement with the invention hanger.

FIG. 8 is the assembly of FIG. 7 and the largest diameter threaded hanging rod 25 in a fully threaded engagement with the invention hanger after having been rotated in direction 31.

Figure 9:
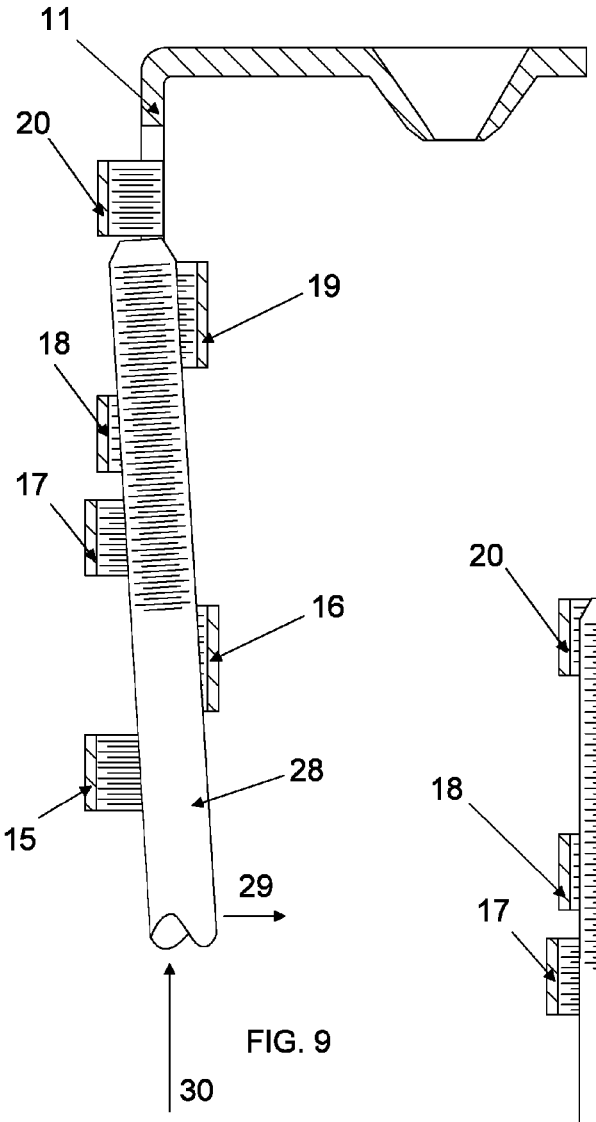
FIG. 9 is the anchor of FIG. 6 showing an angled insertion of a smaller diameter threaded hanging rod into the invention hanger without need for threading up to two thirds of the engaging threads.

FIG. 9 is the anchor of FIG. 6 showing an insertion of a smaller diameter threaded hanging rod 28 into the invention hanger anchor 10 without need for threading up to two thirds of the engaging threads (those of sections 18 and 19) by moving rod 28 first past the larger diameter of the lower rod area and moving rod 28 in direction 29 so that, similar to the actions shown in FIGS. 7 and 8, smaller diameter threaded hanging rod 28 moves past the threads of sections 18 and 19 into the invention hanger 10 without need for threading for up to two thirds or more of the engaging threads in sections 17 and 18.

Figure 10:
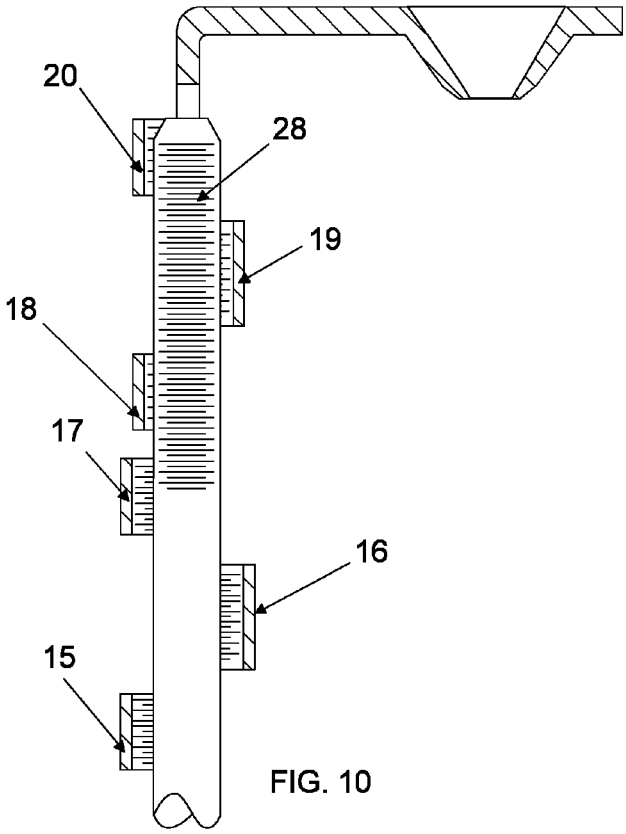
FIG. 10 is the assembly of FIG. 9 showing the smaller diameter threaded hanging rod in a fully threaded engagement with the invention hanger.

FIG. 10 is the assembly of FIG. 9 showing the smaller diameter threaded hanging rod 28 in a fully threaded engagement with the invention anchor 10 at sections 18, 19 and 20.

In a specific example, the upper rod area comprises effective diameter and threads of ¼"-20UNC and the lower rod area of ⅜"-16UNC. Preferably, the difference in effective diameters of the upper rod area and the lower rod area is one fourth inch or less, one eighth inch or less, or one sixteenth inch. In a preferred embodiment, a vertical length of the sections is 12 millimeters or less, 10 millimeters or less, or from 6 to 8 millimeters. Preferably, vertical distance of non-threaded sections is 5 millimeters or less, 4 millimeters or less, or 2 millimeters or more.

It is to be understood that while certain forms of the present invention have been illustrated and described herein, it is not to be limited to the specific forms or arrangement of parts described and shown.

What is claimed is:

1. A suspended ceiling anchor comprising:

(a) an L-shaped bracket comprising a connector plate and a suspended plate;

(b) the connector plate defining an opening adapted to provide attachment to a horizontal structure from which a suspended item may be suspended so that the suspended item is suspended vertically;

(c) the suspended plate comprises a lower rod area and an upper rod area;

(d) each rod area comprises three semi-circular sections, where each semi-circular section has an identical internal diameter and threaded concave surface directed horizontally opposite of an adjacent semi-circular section in its rod area and where the semi-circular sections are arranged adjacent and vertically on a common axis, which is also in a plane of the suspended plate;

(e) each semi-circular section is separated from other semi-circular sections by a non-threaded section; and (f) the semi-circular sections of the lower rod area define a larger threaded diameter adapted to engage threads of a larger threaded hanging rod than the semi-circular sections of the upper rod area that define a smaller threaded diameter adapted to engage threads of a smaller threaded hanging rod.

2. The anchor of claim 1 wherein the larger threaded diameter is greater than the smaller threaded diameter by one fourth of an inch or less.

3. The anchor of claim 2 wherein the larger threaded diameter is greater than the smaller threaded diameter by one eight of an inch or less.

4. The anchor of claim 3 wherein the larger threaded diameter is greater than the smaller threaded diameter by one sixteenth of an inch.

5. The anchor of claim 1 wherein a vertical length of the semi-circular sections is 14 millimeters or less.

6. The anchor of claim 5 wherein a vertical length of the semi-circular sections is 10 millimeters or less.

7. The anchor of claim 5 wherein a vertical length of the semi-circular sections is from 6 to 8 millimeters.

8. The anchor of claim 5 wherein a vertical distance of the non-threaded sections is 5 millimeters or less.

9. The anchor of claim 8 wherein a vertical distance of the non-threaded sections is 4 millimeters or less.

10. The anchor of claim 9 wherein a vertical distance of the non-threaded sections is 4 millimeters or more.

* * * * *